US008353352B2

(12) United States Patent
Leitch

(10) Patent No.: US 8,353,352 B2
(45) Date of Patent: Jan. 15, 2013

(54) SWITCH MECHANISMS THAT ALLOW A SINGLE POWER CABLE TO SUPPLY ELECTRICAL POWER TO TWO OR MORE DOWNHOLE ELECTRICAL MOTORS ALTERNATIVELY AND METHODS ASSOCIATED THEREWITH

(75) Inventor: Andrew Leitch, Aberdeen (GB)

(73) Assignee: RMSpumptools Limited (GB)

( * ) Notice: Subject to any disclaimer, the term of this patent is extended or adjusted under 35 U.S.C. 154(b) by 132 days.

(21) Appl. No.: 12/357,687

(22) Filed: Jan. 22, 2009

(65) Prior Publication Data

US 2009/0183870 A1 Jul. 23, 2009

(30) Foreign Application Priority Data

Jan. 23, 2008 (GB) ..... 0801156.1

(51) Int. Cl.
*E21B 43/12* (2006.01)

(52) U.S. Cl. ..... 166/369; 166/65.1; 166/106

(58) Field of Classification Search ..... 166/381, 166/65.1, 54.1, 106, 369; 340/853.3
See application file for complete search history.

(56) References Cited

U.S. PATENT DOCUMENTS

| | | | | | |
|---|---|---|---|---|---|
| 2,242,166 | A | * | 5/1941 | Bennett | 166/105 |
| 2,831,084 | A | * | 4/1958 | Swinarski | 200/82 R |
| 3,485,299 | A | * | 12/1969 | Young | 166/244.1 |
| 3,741,298 | A | * | 6/1973 | Canton | 166/105 |
| 4,365,506 | A | * | 12/1982 | Hyde | 73/152.61 |
| 4,523,194 | A | * | 6/1985 | Hyde | 340/853.3 |
| 5,769,160 | A | * | 6/1998 | Owens | 166/65.1 |
| 6,435,838 | B1 | | 8/2002 | Marvel et al. | 417/53 |
| 6,598,681 | B1 | * | 7/2003 | Berry | 166/369 |
| 6,889,765 | B1 | | 5/2005 | Traylor | 166/105.5 |

FOREIGN PATENT DOCUMENTS

WO 97/47852 12/1997

* cited by examiner

*Primary Examiner* — David Andrews
(74) *Attorney, Agent, or Firm* — DLA Piper LLP (US)

(57) ABSTRACT

A switch mechanism is provided for inclusion in a downhole production string located in a wellbore. The switch mechanism includes an electrical power input and at least two electrical power outputs. In addition, the switch mechanism includes an actuator mechanism which is capable of being actuated from a position remote from the wellbore to selectively move between at least two positions. The movement thereby provides a selective electrical connection between the input and one of the outputs when the actuator is in one of the at least two positions.

17 Claims, 5 Drawing Sheets

Typical ESP Configuration 10
12
14
16
20
8
18
22
14U
16U
18
26D
26B
9D
24DU
24BU
14L
9B
to lower ESP
14L
24DL
28
30
24BL
18
26C
24CU
9C
18
24CL

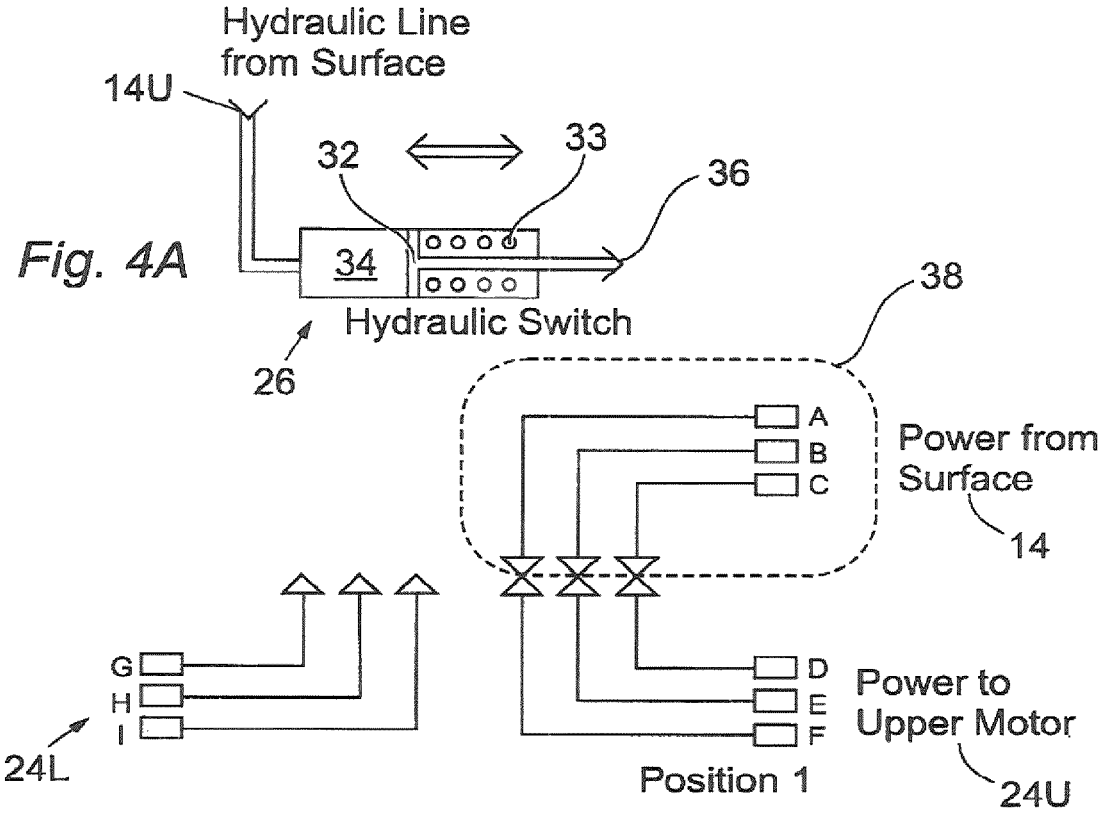
Fig. 4A
Fig. 4B
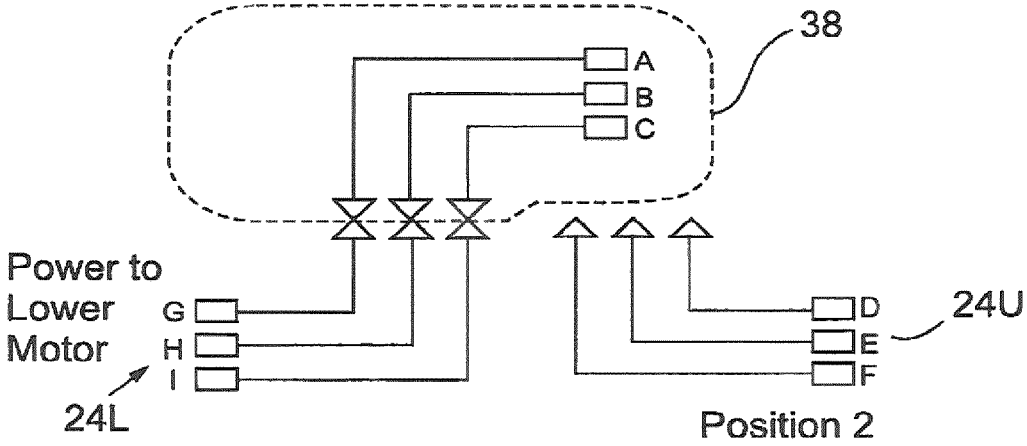
Fig. 4C

SWITCH MECHANISMS THAT ALLOW A SINGLE POWER CABLE TO SUPPLY ELECTRICAL POWER TO TWO OR MORE DOWNHOLE ELECTRICAL MOTORS ALTERNATIVELY AND METHODS ASSOCIATED THEREWITH

FIELD OF THE INVENTION

The present invention relates to an apparatus and method for use downhole to provide power to two or more pumps and more particularly relates to a switch mechanism operable to allow a single power cable to supply electrical power to two or more downhole electrical motors alternatively.

BACKGROUND

Many oil and gas wells must be provided with artificial lift in order to extract the hydrocarbons in an effective manner, otherwise the relatively low natural reservoir pressure (particularly in the middle and latter years of some wells) is not sufficient to flow the well. Conventionally, the artificial lift can be provided by a variety of methods including injection of CO2 into the well to force the hydrocarbons up to the surface and by providing downhole pumps to suck in the hydrocarbons and pump them up production tubing to the surface. An Electrical Submersible Pump (ESP) is a form of artificial lift pump designed to draw fluid from a well in the absence of pressure to suit the production rate required. Typically ESPs, in the oilfield, have been run as single units on the end of the production tubing. A power cable, attached to the electrical motor unit of the ESP extends to the surface of the well alongside the production tubing and terminates at the wellhead.

The power cable will often need to be fed through a packer (a downhole barrier adapted to seal the annular gap between the production tubing and the casing) prior to extending to the surface of the well where the power cable also needs to be fed through the wellhead. At both of these junctions, the power cable usually has to be deployed with an electrical penetrator which seals the cable into the wellhead and packer. It should be noted however that not all ESP wells use packers but all require wellheads and such a typical/conventional configuration of a well having an ESP deployed therein is shown in FIG. 1.

In more recent years, it has become more customary for an operator to want to use a dual ESP configuration, where one ESP is run on top of the other, with a spacing therebetween. This configuration allows one ESP unit to be operated or run to the end of its life and then the second ESP unit is switched on. The benefits of dual ESP systems are considerable in terms of saved workover (well completion replacement), costs and avoidance of oil well downtime.

Conventional dual ESP configurations require a dedicated power cable from each of the dual ESPs to the surface of the well and therefore two power cables are required from the ESP's to the surface.

The power cable feed for the lower ESP motor extends from a plug-in connection at the lower ESP motor, up beyond the upper ESP and is joined by the power cable feed for the upper ESP. From there, both cables extend to the surface of the well and such a typical/conventional configuration of a well having a dual ESP system deployed therein is shown in FIG. 2.

In wells where the power cable has to pass through a packer as well as through the wellhead, special electrical "penetrators" (units which seal the power cable into a steel body) are required.

Dual ESP systems therefore require two penetrators, both for the packer and for the wellheads. Unfortunately, standard wellheads and packers are manufactured with only a single penetrator and cannot be modified to accept twin penetrators. Accordingly, packers and wellheads have to be specially manufactured to suit twin penetrators.

Accordingly, for new wells, packers and wellheads can be specially ordered to accommodate the twin penetrator requirement. However, existing wells would require a conversion and this leads to significant costs due to the large variety of wellhead types and the engineering required. Furthermore, the existing customer owned and very expensive wellheads and packers would therefore be scrapped.

This extra (significant) cost plus the associated lead time in obtaining such new and special wellheads currently makes conversion to dual ESPs non-viable for many existing wells or at least, presents a barrier to conversion to duals ESP systems.

It would therefore be desirable if the existing wellhead (and packer if required) can be utilised; if this was the case then conversion to dual ESPs becomes more viable and presents a significant opportunity to improve ESP viability in all manner of wells.

SUMMARY OF THE INVENTION

According to a first aspect of the present invention there is provided a downhole switch mechanism for inclusion in a production string located in a wellbore, the downhole switch mechanism comprising:

- an inlet for electrical power;
- at least two outlets for electrical power; and
- an actuator mechanism which is capable of being actuated from the surface of the wellbore to selectively move between at least two positions in order to provide a selective electrical connection between the said inlet and one of the said outlets.

According to the first aspect there is provided a method of powering at least two electrically operated devices associated with or included in a production string located downhole in a wellbore via a single electrical cable, the method comprising the steps of:

- providing a switch mechanism in the production string, the switch mechanism being supplied with electrical power from the surface of the wellbore by means of the single electrical cable and further being coupled to at least two downhole devices; and
- actuating, at the surface, the switch mechanism to move between two or more positions, each position being associated with one of the said downhole devices,
- such that electrical power is selectively supplied from the single electrical cable to the selected downhole device.

Preferably, the switch mechanism is incorporated into the production string before it is run into the wellbore.

Preferably, the actuator mechanism further comprises a switch arm mechanism moveable between the at least two positions, and more preferably, each position is associated with one of the said electrical power outlets. Typically, the actuator mechanism is capable of being actuated from the surface, of the wellbore to selectively move the switch arm mechanism between the two positions.

Typically, the downhole devices comprise electrically operated downhole pumps and more preferably the downhole pumps are electrically submersible pumps (ESPs).

Preferably, the switch arm is actuated by means of an actuator mechanism. Preferably, the actuator mechanism is also powered from the surface. In one preferred embodiment, the actuator mechanism comprises a hydraulic fluid powered actuator mechanism and in this preferred embodiment, the actuator mechanism comprises a hydraulic cylinder and piston arrangement, wherein fluid can be injected into or withdrawn from the hydraulic cylinder in order to move the piston. In this preferred embodiment, the piston is mechanically coupled to the switch arm.

Preferably, the switch mechanism is located downhole in the wellbore below a wellhead of the wellbore, where the wellhead of the wellbore is typically located at the surface thereof. Typically, where an annular sealing device such as a packer is included in the production string, the switch mechanism is typically located below the annular sealing device.

Typically, a first branch electrical cable is arranged to connect the first outlet of the switch mechanism to a first ESP and a second branch electrical cable is arranged to connect the second outlet of the switch mechanism to a second ESP. Preferably, the single electrical cable is electrically coupled to the inlet of the switch mechanism such that the single electrical cable supplies power from the surface of the wellbore to the inlet of the switch mechanism, through the switch arm to the selected downhole ESP.

BRIEF DESCRIPTION OF THE DRAWINGS

Embodiments of the present invention will now be described, by way of example only, with reference to the accompanying drawings.

FIG. 4A is a schematic view of a downhole switch mechanism in accordance with the present invention and used in the embodiments shown in FIGS. 3B, 3C and 3D.

FIG. 4B is a schematic view of the downhole switch mechanism of FIG. 4A in a first configuration adapted to provide power to an upper ESP unit.

FIG. 4C is a schematic view of the downhole switch mechanism of FIG. 4A in a second configuration adapted to provide power to a lower ESP unit.

DETAILED DESCRIPTION

Figures 3A, 3B, 3C, 3D:
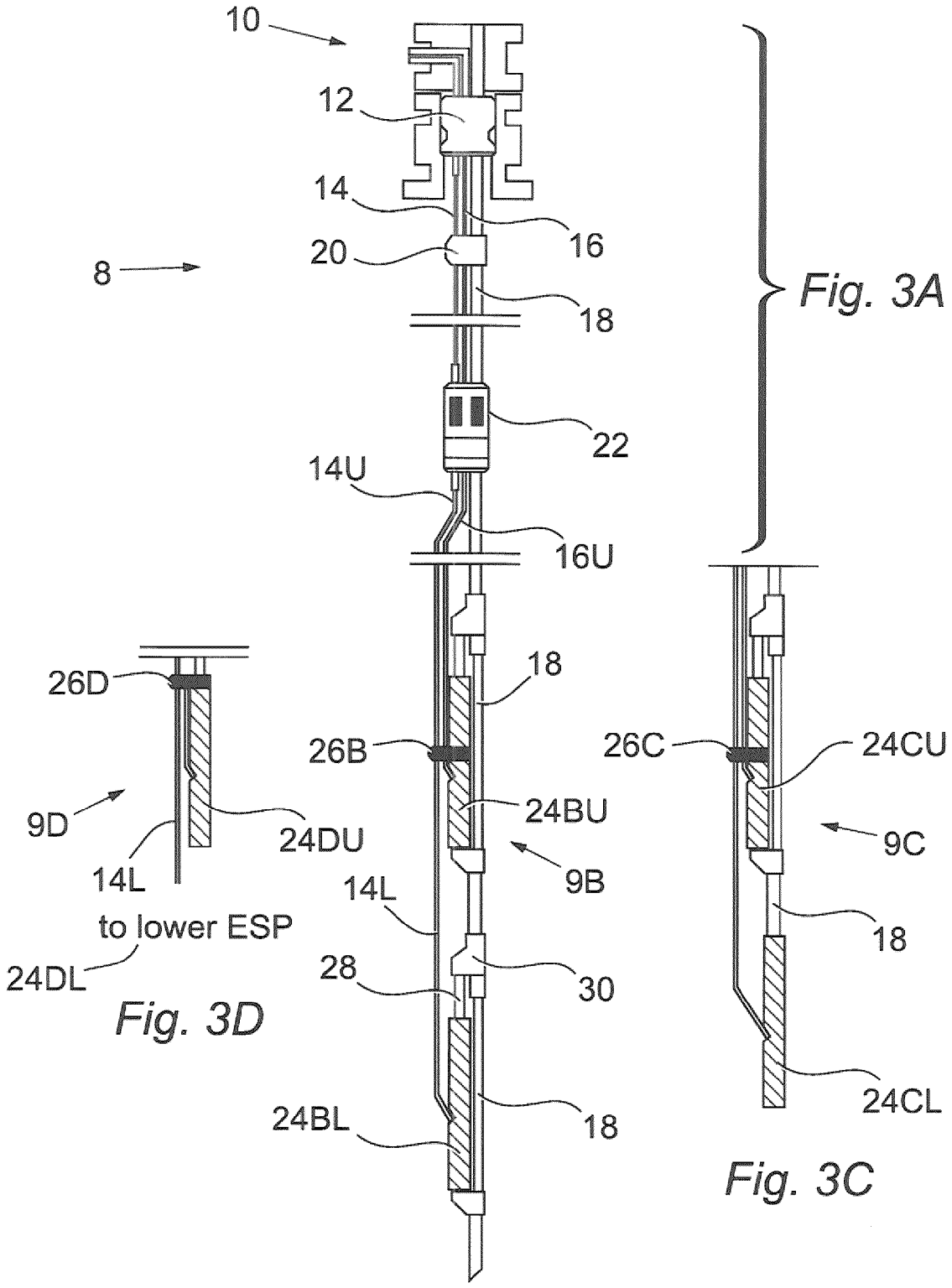
FIG. 3A is a schematic view of a hydrocarbon well system comprising an upper half of completion and production equipment.
FIG. 3B is a schematic view of a first embodiment of a lower half of completion and production equipment incorporating a dual ESP system and a downhole switch mechanism in accordance with the present invention for use with the upper half of FIG. 3A.
FIG. 3C is a schematic view of a second embodiment of a lower half of completion and production equipment incorporating a dual ESP system and a downhole switch mechanism in accordance with the present invention for use with the upper half of FIG. 3A.
FIG. 3D is a schematic view of a third embodiment of a lower half of completion and production equipment incorporating a dual ESP system and a downhole switch mechanism in accordance with the present invention for use with the upper half of FIG. 3A.

FIG. 3A shows the upper portion of a typical downhole completion and production system as comprising a wellhead 10 located at the surface with a conventional single penetrator wellhead hanger 12. A single 3 phase electrical cable 14 passes through the single penetrator 12 and down towards the lower half of the well shown for instance in FIG. 3B. A suitable diameter hydraulic cable 16 such as ¼" diameter also passes through the single penetrator 12 in a conventional manner, but as is also conventional, standard single penetrator wellhead hangers 12 are already provided with the provision or ability to have a relatively small conduit hydraulic line such as ¼" outer diameter conduit to pass through them (as well as a much larger diameter electrical cable 14). As is also conventional, the electrical cable 14 and hydraulic line or conduit 16 are secured to production tubing 18 by means of standard cable protectors 20 which are provided at each joint between each length of production tubing 18, that is every 30 feet. As is also conventional, a standard production packer 22 having a single penetrator therein is provided toward the lower half of the upper half of the completion 8 where the single penetrator of the packer 22 allows the electrical cable 14 (and the hydraulic conduit line 16) to pass through the body of the packer 22.

An embodiment of an apparatus and a method for distributing power downhole with only one electrical cable in accordance with the present invention is shown in FIG. 3B where FIG. 3B generally shows the lower half of a downhole completion 9B. The lower completion equipment 9B comprises production tubing 18 and a pair of ESPs 24BU, 24BL where the production tubing 18 continues on to the bottom of the well to allow the transport of hydrocarbons from the bottom of the well up to the surface. The pair of ESPs 24BU, 24BL shown in FIG. 3B are arranged in parallel with the production tubing 18 and, for the configuration shown in FIG. 3B, the pair of ESPs 24BU, 24BL would typically remain dormant until the hydrocarbons had been produced from the bottom of the well and can no longer be produced from that deep region. At such a point, the operator may take the decision to activate the lower ESP 24BL such that it pumps hydrocarbons from its locality upwards through outlet pipe 28 and into the inverted Y-shaped branch joint 30 and then up through the rest of the production tubing 18 to the surface.

A hydraulic switch module 26B is conveniently located close to the upper ESP 24BU.

In general, the hydraulic switch 26B can be actuated with hydraulic fluid supplied through the hydraulic line 16 from the surface to move an electrical connector or switch arm 38 such that the electrical power delivered through the electrical cable 14 can be delivered to either the upper ESP 24BU or the lower ESP BL. More details of the hydraulic switch 26 are shown in FIGS. 4A, 4B and 4C and will now be described.

FIG. 4A shows the hydraulic switch 26 as comprising a single acting piston 32 with a heavy duty return spring 33 located within a hydraulic fluid cylinder or piston chamber 34. The hydraulic line 16 (which is purged before use) extends from the surface down to the switch module 26B and connects directly to the piston chamber 34. Accordingly, hydraulic fluid from the surface can be delivered through the hydraulic line 16U and injected into the piston chamber 34 or withdrawn from it in order to move the position of the piston head 32 to the left or right of the position shown in FIG. 4A. The outer end of the piston 32 is mechanically coupled at location 36 to a driver mechanism in the form of a switch arm 38 shown in dotted lines in FIGS. 4B and 4C. The switch arm 38 is electrically coupled via contacts A, B and C to the three phases of the electrical cable 14. Accordingly, movement of the piston 32 directly moves the switch arm 38 and thus the switch contacts A, B and C between position 1 and position 2.

The motor of the upper ESP 24U comprises 3 electrical power inputs D, E, F and the motor of the lower ESP 24L comprises 3 electrical power inputs G, H, I.

The hydraulic switch 26 has two configurations or positions:

position 1 shown in FIG. 4B where the switch arm 38 electrically couples the three phases A, B and C of the electric cable 14 to the three phases D, E and F of the upper ESP 24U. In this position, the three phases G, H and I of the lower ESP 24L are shown as being isolated. Accordingly, position 1 provides full power to and operation of the upper ESP 24U whilst the lower ESP 24L remains dormant.

position 2 of the switch arm 38 is shown in FIG. 4C where the switch arm 38 has been moved by the piston 32 via the mechanical coupling 36 such that the three phases A, B and C of the electric cable 14 are now electrically coupled to the three phases G, H and I of the lower ESP 24L. Accordingly, position 2 provides full power to and operation of the lower ESP24L whilst the upper ESP 24U becomes dormant.

Consequently, the operator can, from the surface, select which of the two ESPs 24BL, 24BU to operate by actuating the hydraulic switch 24B with surface control equipment to move the piston 32 against the return spring 33 to move the switch arm 38 to the desired position 1 or 2, all the while only having to run one electric cable from the surface down to the dual ESPs 24BU, 24BL. The operator can lock the pressure in the hydraulic fluid at the surface to hold the position 1 or 2 of the switch arm 38.

An alternative lower half of the completion 9C is shown in FIG. 3C where the lower ESP 24CL constitutes the lowermost portion of the completion 9C and its output feeds straight into the lowermost end of the production tubing 18. As can be seen in FIG. 3C, the upper ESP 24CU and the switch 26C are arranged in a similar manner to the upper ESP 24BU and the switch 26B of the system 9B of FIG. 3B.

A further alternative arrangement of ESPs is shown in system 9D in FIG. 3D where only one ESP 24DU is shown but where there is another lower ESP 24DL located much further down the wellbore and which is supplied with electrical power via electric cable 14L. The main difference, however, between the ESP 24DU shown in FIG. 3D and the ESP 24BU shown in FIG. 3B is that the hydraulic switch 26D is shown as being located at the upper most end of the ESP 24DU rather than being located mid-way down the ESP 24BU.

Figure 3E:
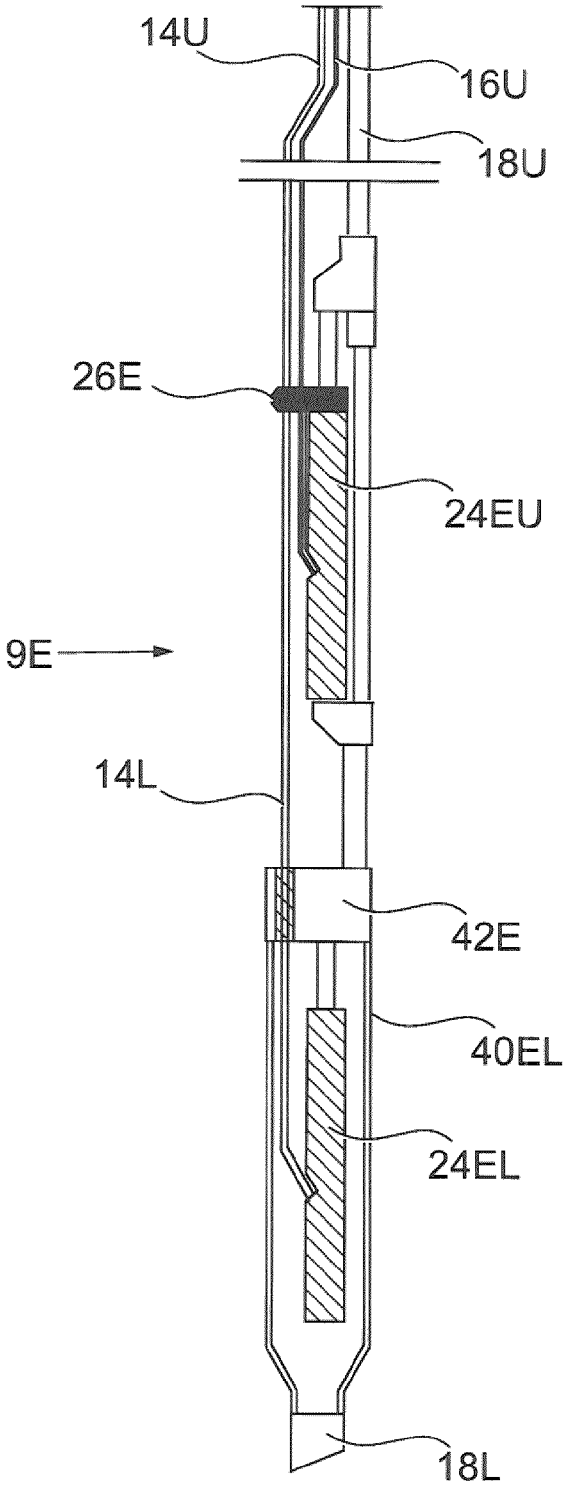
FIG. 3E is a schematic view of a fourth embodiment of a lower half of completion and production equipment incorporating a dual ESP single by-pass and single can system and a downhole switch mechanism in accordance with the present invention for use with the upper half of FIG. 3A.

FIG. 3E shows a further alternative arrangement of ESPs 24EU, 24EL where the difference compared to the system 9B in FIG. 3B is that the lower ESP 24EL is enclosed within a can or housing 40EL. The can 40EL comprises a sealed cap 42E at its upper most end and the lower end of the can 40EL is attached to the lower section of production tubing 18L. The can 40EL acts to isolate the reservoir zone served by the lower ESP 24EL from the reservoir zone served by the upper ESP 24EU. Accordingly, the system 9E provides a dual ESP with single bypass and single can system for operation in dual zones and the hydraulics switch 26E can be operated as previously described to switch on either of the ESPs 24EU, 24EL to pump reservoir fluid from the desired respective zone.

Figure 3F:
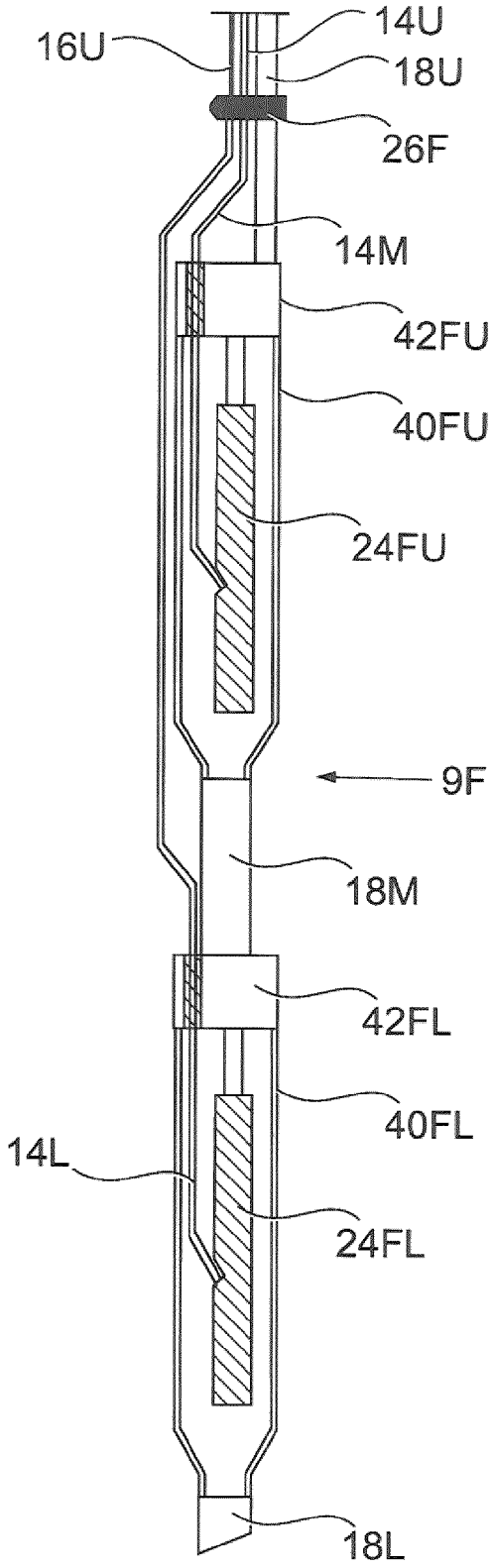
FIG. 3F is a schematic view of a fifth embodiment of a lower half of completion and production equipment incorporating a dual ESP dual can system and a downhole switch mechanism in accordance with the present invention for use with the upper half of FIG. 3A.

A further alternative arrangement of ESPs 24FU, 24FL is shown in FIG. 3F where the system 9F shown therein again comprises a pair of ESPs 24FU, 24FL provided with respective cans 40FU, 40FL where the lower end of the upper can 40FU is connected to a middle section of production tubing 18M and the lower end of that production tubing 18M is connected to the upper end of the sealed cap 42FL of the lower can 40FL. The lower end of the lower can 40FL is connected to the upper end of the lower production tubing section 18L and the switch 26F is located above the upper ESP 24FU, and the sealed cap 42FU of the upper can 40FU. Accordingly, a first electric power cable 14M branches out of the hydraulic switch 26F to deliver power to the upper ESP 24FU and a second electric cable 14L branches out of the hydraulic switch 26F to provide power to the lower ESP 24L but, as with the previous embodiments, only one electric cable 14U and one hydraulic conduit 16U are required to be run from surface to the downhole hydraulic switch 26F. Accordingly, the system 9F shown in FIG. 3F provides redundancy in a single zone reservoir in that reservoir fluids can be pumped up through the lower production string 18L by either the lower ESP 24FL or the upper ESP 24FU and up through the upper production string 18U and therefore redundancy is provided if either ESP 24FL, 24FU were to fail.

Figure 2:
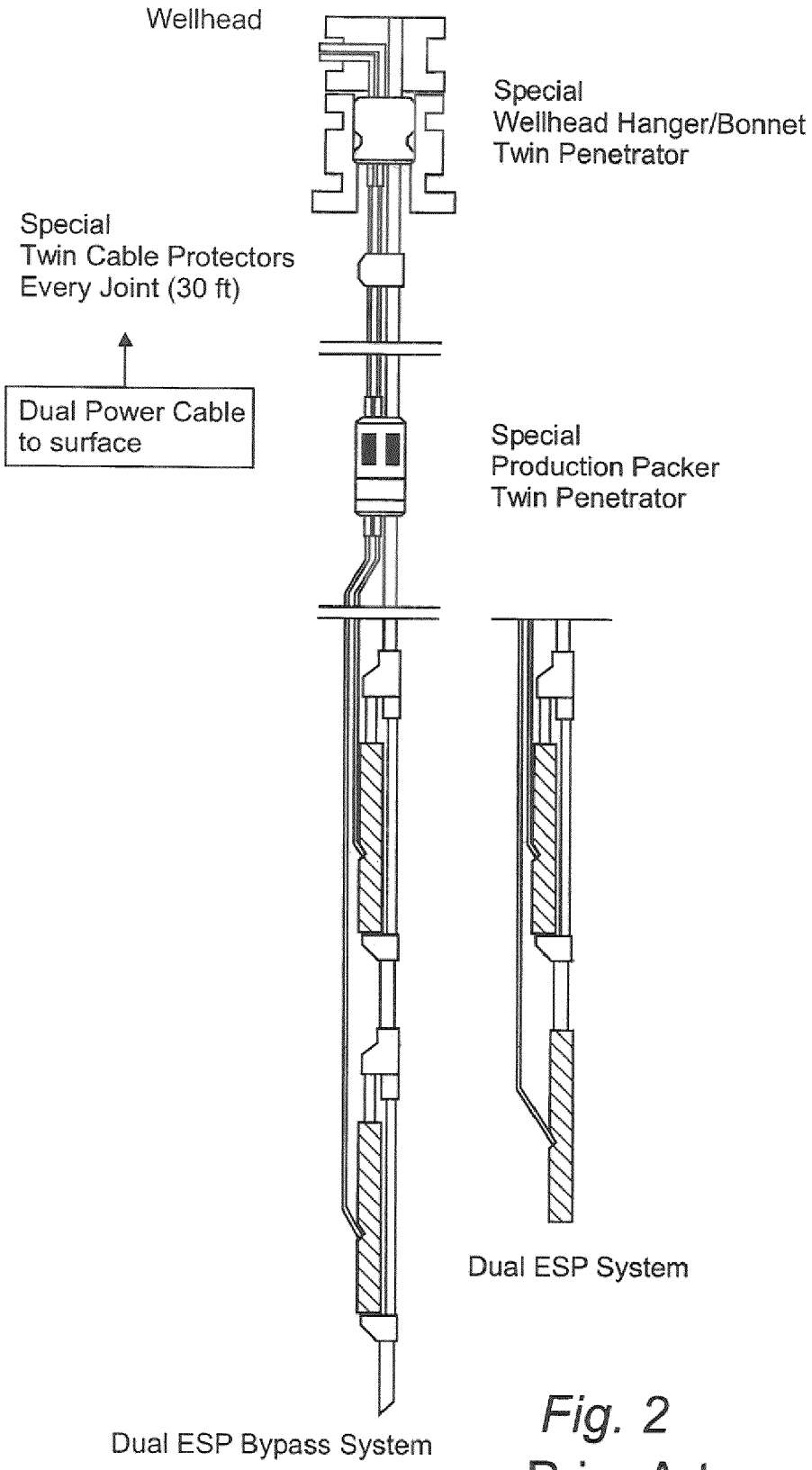
Fig. 2 Prior Art
FIG. 2 shows a dual ESP bypass system.

Accordingly, the embodiments described herein provide the great advantage that power can be remotely switched between an upper ESP 24U and a lower ESP 24L where the power is supplied via one electric cable 14 and this provides the further advantage that only one power cable 14 is required to penetrate the wellhead 10 and therefore allows existing standard wellhead equipment 10 to remain in place, unlike the prior art dual ESP system shown in FIG. 2. Furthermore, if a packer is present, only single penetrators are required at both the wellhead 10 and packer 22, meaning both of these penetrators and the associated wellhead 10 and packer 22 are standard equipment which thereby minimises the costs and manpower required to install the system (unlike the non-standard wellhead hanger/bonnet twin penetrator and the non-standard production packer having a twin penetrator shown in FIG. 2).

Figure 1:
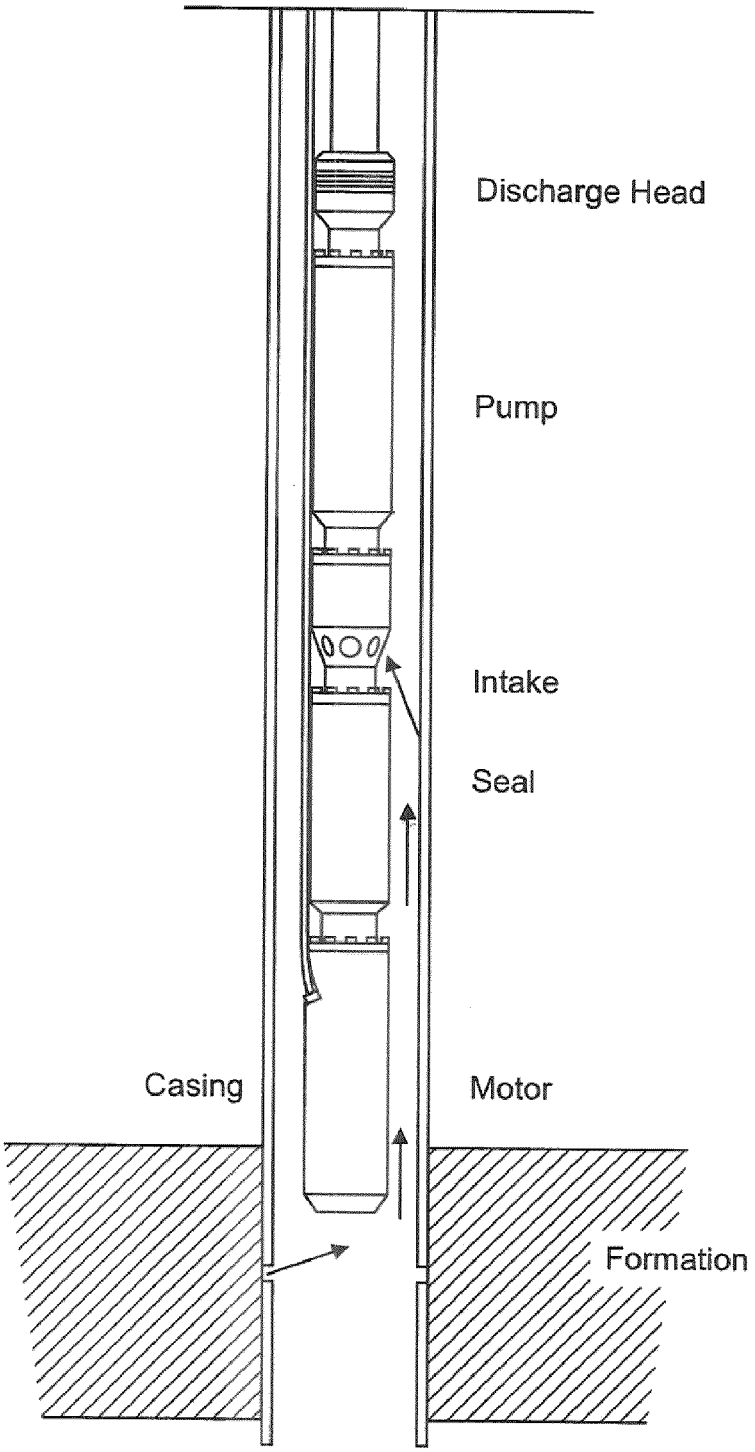
Fig. 1 Prior Art
FIG. 1 shows a typical ESP configuration.

Importantly, although an additional hydraulic line 16 to surface is required over a prior art single ESP system such as that shown in FIG. 1, conventional wellheads 10 and packers 22 are already furnished with small bore feedthrough porting for various applications to allow hydraulic lines such as line 10 to be passed therethrough. Furthermore, as the cost of rig time is so high, the switch 26 and the associated cabling and conduit arrangement will have the added benefit of significant time saving.

Importantly, it should be noted that the downhole switch 26 can be located anywhere under the wellhead 10 but, the lower it is positioned in the well, the less cable 14 is deployed downhole which means lower cabling costs. In fact, the choice to position the switch 26 directly under the wellhead 10, or at the upper dual ESP 24U will differ from case to case. Cable 14 is more vulnerable the deeper it goes so some users may wish to double the cable 14 on the underside of the wellhead 10 to maximize the reliability of the system and to avoid the potential failure on the cable 14 leading to both ESP units 24U, 24L being inoperable. Typically, if a packer 22 is used the cable 14 below the packer 22 is more vulnerable to downhole conditions than the cable 14 above the packer. Accordingly, the choice of positioning the switch 26 above or below the packer 22 will be made on a case by case basis depending on the operator's requirements.

If desired, the switch 26 could be modified by those skilled in the art without departing from the scope of the invention to provide third and fourth positions to allow further ESPs 24 to be added if, for instance, a triple or quadruple ESP 24 system was required by an operator.

Accordingly, the key benefits of embodiments of the present invention are:

1. Only one power cable 14 to surface is required and thus the cable 14 cost is potentially halved;
2. Only require a single penetrator at packer 22 and thus a standard ESP packer 22 can be used;
3. Only require a single penetrator 12 at wellhead 10 and thus a standard ESP wellhead 10 can be used, giving greater flexibility for hanger size;
4. Standard protector clamps 20 can be used (in the case of a deep set switch 26);
5. Minimal cost and disruption to convert to dual ESPs 24U, 24L thus benefiting from improved cost improvements on well production; and
6. Brings in the potential to deploy more than two ESPs 24U, 24L downhole such as triple ESP systems or quadruple ESP systems.

Modifications and improvements may be made to the embodiments hereinbefore described without departing from the scope of the invention. For instance, the hydraulically operated switch 26 could be modified or replaced with an electrical solenoid actuator that could be operated from the surface by, for instance, modulating instructions/control signals onto the three phase electrical supply provided through the electrical cable 14 and this would have the advantage that the hydraulic line 16 could then be omitted and such an electrical solenoid actuator could be powered from the electrical cable 14 itself.

What is claimed is:

1. A switch mechanism for inclusion in a downhole string located in a well bore formed in a surface, the switch mechanism comprising:

an electrical power input connected to an electric line;

at least two electrical power outputs; and an actuator mechanism that is actuated remotely from the wellbore to selectively move between at least two positions to provide a selective electrical connection between the input and one of the outputs;

wherein 1) the actuator mechanism comprises a hydraulic fluid powered actuator mechanism actuated from the surface via a hydraulic line;

2) a first annular sealing device is included in the downhole string above the switch mechanism, the first annular sealing device comprising a penetrator and a separate feedthrough porting;

3) the hydraulic line extends from the surface downwardly through the feedthrough porting and downwardly to the actuator mechanism to supply the hydraulic fluid to the actuator mechanism and is provided separate to a production tubing that transports hydrocarbons from a bottom portion of the wellbore up to the surface;

4) wherein the electric line extends separately from the hydraulic line and downwardly from the surface through the penetrator and downwardly to the switch mechanism; and 5) each electrical power output connects to the power input of respective Electrically operated downhole Submersible Pumps (ESPs).

2. The switch mechanism of claim 1, wherein the actuator is in one of said at least two positions to connect said input and one of said outputs.

3. The switch mechanism of claim 2, wherein in a second of said at least two positions, the selective electrical connection is made between the input and a second one of said outputs.

4. The switch mechanism of claim 1, wherein the actuator mechanism comprises a switch arm mechanism moveable between the at least two positions.

5. The switch mechanism of claim 1, wherein the actuator mechanism is actuated from the surface of the well bore to selectively make an electrical connection.

6. The switch mechanism of claim 1, wherein the downhole string comprises a production string and the switch mechanism is incorporated into the production string before it is run into the wellbore.

7. The switch mechanism of claim 1, wherein the actuator mechanism comprises a hydraulic cylinder and piston arrangement, wherein fluid can be injected into or withdrawn from the hydraulic cylinder to move the piston between said at least two positions.

8. The switch mechanism of claim 1, wherein a second annular sealing device is included in the downhole string and the switch mechanism is located below the second annular sealing device.

9. The switch mechanism of claim 1, wherein the first annular sealing device is a wellhead.

10. A method of powering at least two electrically operated devices associated with or included in a string located downhole in a well bore via a single electrical cable, the method comprising:

providing a switch mechanism in a downhole string, the switch mechanism being supplied with electrical power from a surface of the well bore by the single electrical cable, the switch mechanism being further coupled to at least two downhole devices; and remotely actuating the switch mechanism from the surface via a hydraulic line actuating a hydraulic fluid powered actuator mechanism to move between two or more positions, each position being associated with one of the downhole devices, such that electrical power is selectively supplied from the single electrical cable to the selected downhole device;

1) wherein a first annular sealing device is included in the downhole string above the switch mechanism, the first annular sealing device comprising a penetrator and a separate feedthrough porting;

2) wherein the hydraulic line extends from the surface downwardly through the feedthrough porting and downwardly to the actuator mechanism to supply the hydraulic fluid to the actuator mechanism and is provided separate to a production tubing used to transport hydrocarbons from a bottom portion of the wellbore up to the surface;

3) wherein the electric line extends separately from the hydraulic line and downwardly from the surface though the penetrator and downwardly to the switch mechanism; and 4) each electrical power output connects to the power input of respective Electrically operated downhole Submersible Pumps (ESPs).

11. The method of claim 10, further comprising connecting the input with a first one of said outputs when the switch mechanism is in a first position.

12. The method of claim 10, further comprising moving a switch arm mechanism between the at least two positions to operate the switch mechanism.

13. The method of claim 12, further comprising actuating the switch mechanism from the surface of the well bore to selectively move the switch arm mechanism between the at least two positions.

14. The method of claim 10, further comprising incorporating the switch mechanism into the downhole string before it is run into the well bore.

15. The switch mechanism of claim 1, further comprising a second annular sealing device included in the downhole string between the switch mechanism and the first annular sealing device.

16. The switch mechanism of claim 15, wherein the second annular sealing device is a packer.

17. A system for powering at least two Electrically operated downhole Submersible Pumps (ESPs) associated with or included in a string located downhole in a well bore formed in a surface, the system comprising:

a switch mechanism for inclusion in a downhole string located in a wellbore, and comprising an electrical power input connectable to an electric line; at least two electrical power outputs; and an actuator mechanism which is capable of being actuated remotely from the wellbore to selectively move between at least two positions to provide a selective electrical connection between the input and one of the outputs;

a single electrical supply to the switch mechanism;

an electrical supply from the at least two electrical power outputs of the switch to the at least two electrically operated downhole submersible pumps;

a first annular sealing device included in the downhole string above the switch mechanism, the first annular sealing device comprising a penetrator and a separate feedthrough porting; and a remote actuator that activates the actuator mechanism to switch the selective electrical connection to one of said at least two ESPs;

wherein the remote actuator supplies fluid through a hydraulic line extending from the surface down though the feedthrough porting and downwardly to the actuator mechanism to activate the actuator mechanism; and wherein the electric line extends separately from the hydraulic line and downwardly from the surface through the penetrator and downwardly to the switch mechanism.

* * * * *